US005145827A

United States Patent [19]

Imai et al.

[11] Patent Number: 5,145,827

[45] Date of Patent: * Sep. 8, 1992

[54] DYE-RECEIVING SHEETS FOR DYE TRANSFER TYPE THERMAL PRINTING

[75] Inventors: Akihiro Imai, Ikoma; Tetsuji Kawakami; Hiromu Matsuda, both of Katano; Keiichi Yubakami, Suita; Nobuyoshi Taguchi, Ikoma, all of Japan

[73] Assignee: Matsushita Electric Industrial Co., Ltd., Osaka, Japan

[ * ] Notice: The portion of the term of this patent subsequent to Jul. 2, 2008 has been disclaimed.

[21] Appl. No.: 537,232

[22] Filed: Jun. 12, 1990

[30] Foreign Application Priority Data

Jun. 14, 1989 [JP] Japan ..... 1-151799

[51] Int. Cl.[5] ..... B41M 5/035; B41M 5/26

[52] U.S. Cl. ..... 503/227; 428/195; 428/421; 428/447; 428/480; 428/500; 428/522; 428/913; 428/914

[58] Field of Search ..... 8/471; 428/195, 913, 428/914, 421, 422, 500, 480, 447, 522; 503/227

[56] References Cited

FOREIGN PATENT DOCUMENTS 261505 3/1988 European Pat. Off. .
312637 4/1989 European Pat. Off. .
336394 10/1989 European Pat. Off. .
361522 4/1990 European Pat. Off. .
392790 10/1990 European Pat. Off. .

OTHER PUBLICATIONS

Database WPIL, No. 87-288265, Derwent Publications Ltd., London, GB; & JP-A-62201290 (Tokyo Jiki) Apr. 9, 1987.

*Primary Examiner*—Bruce H. Hess
*Attorney, Agent, or Firm*—Wenderoth, Lind & Ponack

[57] ABSTRACT

It can be obtained a receiving sheet for a dye transfer type thermal printing which is improved in a curing speed, image reliability, recording sensitivity, and dot reproducibility, and useful for high speed and/or relative-speeds printing by arranging a polymer layer on a substrate and then a cured resin layer of a moisture-curable resin on the polymer layer.

8 Claims, 1 Drawing Sheet

DYE-RECEIVING SHEETS FOR DYE TRANSFER TYPE THERMAL PRINTING

BACKGROUND OF THE INVENTION

1. Field of the Invention

This invention relates to receiving sheets used for dye transfer type thermal printing using a printing means, for example, a thermal head, an optical head for laser beam, et., or a head consisting of an array of electrodes. And it relates particularly to receiving sheets useful for high-speed printing and/or relative-speeds printing in which printing is conducted while controlling the relative speeds of a transfer sheet and a receiving sheet so as to make them different from each other.

2. Description of the Prior Art

It has been proposed that a polymer layer is provided between a substrate and a dyeable layer so as to improve reproducibility of dots (for instance, Japanese patent Application Kokai (laid opeon to public inspection) Nos. 61-121993, and 61-144394)). Further, it has been proposed that a removable layer which is excellent in dye permeability is additionally arranged on a dyeable thermoplastic polymer layer which is laminated on a cellulose layer in order to prevent the adhesion of a color sheet onto the polymer layer (Jap. Pat. Appln. Kokai No. 59-165688). There have been proposed various kinds of thermocurable resin as a dyeable material.

In case that a dyeable layer of a dye-receiving sheet to be used in a high-speed printing, especially a high speed relative-speeds printing system is constituted with a thermoplastic resin, a shear stress is applied on the intersurface between a coloring layer of a transfer sheet and a dyeable layer of a receiving sheet under pressure, so that the dyeable layer made of the thermoplastic resin is liable to soften up with heat on its inter-surface and to become deformed, even if a lubricant exists on the surface. Accordingly, a thermocurable resin excellent in heat resistance is useful as a material for the dyeable layer. Particularly, a moisture-curable resin in the thermocurable resins is most suitable in the aspect of an image stability because it leaves little unreacted resin on the surface of the dyeable layer. A moisture-curable resin, however, has a defect of lower curing speed in comparison with an ultraviolet curable resin which has the highest curing speed of a thermocurable resin.

As another proposal there is suggested a multi-layer dye-receiving sheet which has two or more layers on a substrate. One example of such a multi-layer dye-receiving sheet has an outer surface layer made of epoxy resin, but the curing rate is not only slower but also longer time is necessary to make the surface tack-free.

Furthermore, it includes many problems in the aspect of the image stability and recording sensitivity to provide a layer of a removable material as an upper surface layer as described in Jap. Pat. Appln. Kokai No. 59-165688, though the layer is made of a material excellent in dye permeability, because the dye from a color sheet has a tendency to be dyed predominantly on the upper surface portion of the receiving sheet.

In case of multi-layer constitution other problems will be given rise to due to the more complicated constitution than one layer constitution, for instance, increase of the cost, lowering of the producibility, and curing inhibition by oxygen, water and the like in the air, which will occur more frequently when a thinner UV-curable resin or an thinner ion-curable resin is used as combined with a thin upper surface layer made of thermocurable resin.

SUMMARY OF THE INVENTION

The object of the present invention is to provide a dye-receiving sheet useful for a high speed and/or relative speed printing, which is improved in curing rate, image stability, recording sensitivity, dot reproducibility and the like by arranging multiple layers containing an upper surface layer of a specific resin on a substrate.

A dye-receiving sheet of the present invention comprises a polymer layer (2) on a substrate (1), and a cured resinous layer (3) made from a moisture-curable resin on said polymer layer (2).

DETAILED DESCRIPTION OF THE INVENTION

Figure 1:
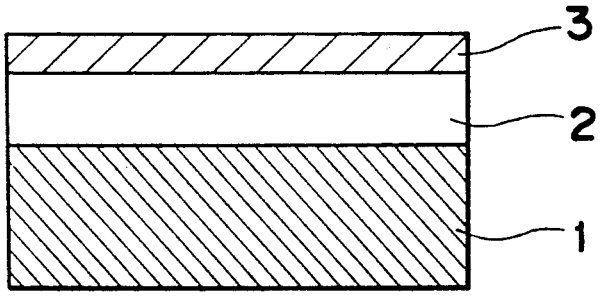
FIG. 1 is a sectional schematic view of a dye-receiving sheet for dye transfer type thermal printing according to the present invention.

In FIG. 1 is shown in a sectional schematic view of a dye-receiving sheet for dye transfer type printing which is one embodiment of the present invention, in which on the substrate (1) the polymer layer (2) is formed, and the cured resinous layer (3) made from a moisture-curable resin is formed on the layer (2). The substrate (1) is not restrictive, but may preferably include synthetic paper, white extruded films, transparent films, paper, laminated sheets of film and paper, and coated sheets obtained by coating various kind of coat such as a primer coat (anchor coat), an antistatic layer, a remover, etc. on an aforementioned films, paper or sheets.

The polymer layer (2) may be made from various kinds of thermoplastic resin or thermocurable resin. These resins may include polyester resins, epoxy resins, urethane resins, (meth)acryl resins, cellulose acetate resins, polyvinyl acetal resins, amide resins, phenol resins, oligoacrylate resins, polystyrenes, polyvinyl chlorides, polyvinyl acetates, and the like. Copolymers or modified polymers of these polymers, of course may be used. Most suitable polymer may be polymers excellent in dyeability, for instance, saturated polyesters, polyurethanes, polyvinylacetals, polystyrenes, polyvinyl acetates, polyvinyl chlorides, polyepoxides, polyacryl resins, and copolymers or modified polymers thereof in the both aspects of recording sensitivity and the reproducibility of dot. Further, a water soluble resin, a water dipersible resin, a polyvinylacetal resin, various kinds of thermocurable resin are useful as the polymer layer (2) because of their high solvent durability.

The thickness of the polymer layer (2) may be preferably 1 μm–10 μm, more preferably 2 μm–6 μm. If the thickness is less than 1 μm the dot reproducibility (image quality) is liable to become worse, whereas when it is thicker than 10 μm the sheet cost becomes unprofitable, and the recording properties cannot be improved as much as the increase of the cost.

The cured resinous layer (3) made from a moisture-curable resin contains at least a cured resin of a moisture-curable resin.

The moisture-curable resin usable in the present invention may include a resin having a hydrolyzable silyl, and/or isocyanato group at the end of a molecule or in the side chain. The moisture-curable resin may contain an acryl, ester, urethane, amide, ether or epoxy group in the molecule, and the cured resins from the moisture-curable resin having such a group can exhibit an excellent dyeability. Further, a moisture-curable resin prepared or modified from halogenized hydrocarbon, acrylonitrile, cellulose or derivative thereof shows similar properties. It is considered that the curing of the dyeable layer begins from the surface and then progresses into the inside thereof, because the resin is cured by a moisture of circumstances such as atmosphere. Therefore, the whole coating layer cures more rapidly as the thickness of said layer is thinner. According to the above reason even when the thickness of the coating layer is thinner the curing inhibition of the layer will not occur, but rather it becomes easy to cure. Though it has been recognized that the reproduction of the dot declines according to the reduction of curable layer in thickness, such a defect can be removed by the arrangement of the polymer layer on the substrate. Further, as the upper surface layer itself can also function as a dyeable layer, this embodiment is advantageous in the aspect of the image reliability and recording sensitivity.

As a hydrolyzable silyl group there is exemplified a silyl group in which a silicon atom is bound with a halogen atom, or a hydride, alkoxy, acyloxy, amino, amide, aminooxy, alkenyloxy, oxime, thioalkoxy or phenoxy group. Such a silyl group is concretely illustrated in Jap. Pat. Appln. Kokai No. 60-231722, and a method of forming a hydrolyzable functional group is described in, for example, Jap. Pat. Appln. Kokai No. 54-123192.

As a moisture-curable resin having a hydrolyzable silyl group at a terminal position or a side chain which is usable in the present invention there are described in Jap. Pat. Appln. Kokai Nos. 59-232110, 60-26022, 60-133019, 60-231722, 61-106607, 61-200116, 51-73561, 58-29818, 54-36395, 54-123192, and 62-292820, and Japanese Patent Publication (Kokoku) Nos. 46-30711, 45-36319, 46-12154, and 47-26415. Particularly preferable effect can be obtained using as an essential or main component of the moisture-curable resin a homo- or copolymer of monomers selected from the group consisting of (meth)acrylic acid and its derivatives such as methyl acrylate, methyl methacrylate, butyl acrylate, butyl methacrylate, acrylonitrile and the like, styrene, α-methyl styrene, alkyl vinyl ether, vinyl chloride, vinyl acetate, vinyl propionate, ethylene and the like.

As the resin having a hydrolyzable isocyanate group at the end of a molecule which is usable in the present invention there are exemplified polyurethanes having one or more NCO terminal group(s), which can be obtained from the reaction of a compound containing two or more active hydrogen atoms (e.g. polypropylene glycol) with organic polyisocyanate (e.g. tolylene diisocyanate). Such a resin having a hydrolyzable isocyanate group is described in, for instance, Jap. Pat. Appln. Kokai (Laid-Open) Nos. 57-147511, 57-94056, 59-215310, and 60-231722.

Among the moisture-curable resins, the following resins are particularly useful. Acryl silicon resins give a highly heat-resistant dyeable layer and hence can serve particularly for high-speed printing. Urethane silicon resins are excellent in dye-affinity and light resistance and hence can be used for forming a dyeable layer having a high printing sensitivity and a high light resistance. Acryl urethane silicon resins give a dyeable layer which have a high printing sensitivity and can serve for high-speed printing, because their compositions can be chosen in a wide range.

Fluorine-containing moisture-curable resins obtained by introducing fluorine into the moisture-curable resins described above are particularly useful because they have a very excellent preventing effect on the fusion to a color sheet. Even when a moisture-curable resin having a molecular structure which permits thermally easy softening is used in order to increase the dyeing sensitivity, it is not fused to a color sheet at all when used together with the fluorine-containing moisture-curable resin.

Particularly the fluorine-containing resin into which at least one of perfluoroalkyl group is introduced is most interested because of its excellent effect. Most useful fluorine-containing moisture-curable resin is one described in Jap. Pat. Appln. Kokai No. 62-558.

Silicone-containing moisture-curable resins obtained by introducing a silicone group into the moisture-curable resins described above are useful because they impart lubricity to the surface of dyeable layer. A silicone group can be introduced into the resins by the use of various reactive silicone oils, reactive siloxane oligomers and the like which are modified with, for example, SiH, silanol, alkoxy, alcohol, carboxyl, epoxy, vinyl compounds, and allyl compounds.

Moisture-curable resins modified with both fluorine and silicone can be advantageously used. The average molecular weight of the moisture-curable resin used in the present invention is usually 500 to 100,000, preferably 1,000 to 50,000.

Various reactive silicone oils may be added into moisture-curable resins. The reactive silicone oils includes, for example, various silicone oils modified with SiH, silanol, alkoxy, alcohol, carboxyl, epoxy groups, etc. It is also possible to introduce various functional groups such as epoxy, hydroxy, etc. into the moisture-curable resins and use reactive silicone oils which react with these functional groups. In addition, it is also possible to use, as additives, various silicone oils, various modified silicone oils, various coupling agents of silane series, titanate series, aluminum series and the like, etc. As described above, reaction cured products of the moisture-curable resins with the various reactive silicone oils are very effective in preventing the fusion to a color sheet and in imparting lubricity to the dyeable layer.

In curing the moisture-curable resin is preferable used together with a curing accelerator (a curing catalyst). As the curing accelerator, there can be used titanates, amines organotin compounds, acidic compounds, etc., for example, alkyl titanates; metal salts of carboxylic acids such as tin octylate, dibutyltin dilaurate, dibutyltin maleate and the like; amine salts such as dibutylamine-2-hexoate and the like, and the curing catalysts disclosed in Jap. Pat. Appln. Kokai (Laid Open) Nos. 58-19361, 60-51724 and 60-13850. The adding amount of the curing accelerator is usually 0.001 to 20% by weight based on the weight of the resin.

When the moisture-curable resin is used in the form of a coating material or the like, a storage stabilizer may be incorporated into the coating material, if necessary. The storage stabilizer includes, for example, the stabilizers disclosed in Jap. Pat. Appln. Kokai (Laid-Open) 60-51724 and 57-147511, etc.

The dyeable layer may contain various polymers other than the moisture-curable resin. Such polymers are preferably those having an excellent dye-affinity for disperse dyes. There can be used, for example, polyester resins, epoxy resins, urethane resins, acrylic resins, cellulose acetate resins, polyvinyl acetal resins, etc.. A high printing sensitivity can be attained particularly when a moisture-curable resins are used in combination with saturated polyester resins, urethane resins, polyvinyl acetal resins, styrene resins, vinyl acetate resins, etc.

The cured resin layer of the moisture-curable resin has a function as a dyeable layer which is dyed with a dye supplied from the dye-transfer sheet. It is preferable to make a polymer layer of a polymer dyeable with a dye from the transfer sheet, but it is not restrictive.

The polymer layer (2) and the the cured resin layer (3) may contain additives such as a particle, lubricant, a surfactant, an antistatic agent, an ultraviolet absorbing agent, an antioxidant and the like.

The present invention is specifically illustrated by means of non-limiting Examples. All parts and percentages in the Examples, are by weight unless otherwise specified.

EXAMPLE 1

A white polyethylene terephthalate (PET) film (U-12available from Teijin Ltd.; thickness 100 μm) was used as a substrate. One side of the substrate was coated with a polyester type adhesive agent containing isocyanate to form an anchor coat layer of about 0.1 μm in thickness. The anchor coat layer was coated with a coating composition containing butyral resin (BX-1, available from SEKISUI CHEMICAL CO., LTD.) 2 parts, toluene 20 parts, 2-butanone 10 parts, and isopropyl alcohol 10 parts to form a polymer layer of about 3 μm thick. By means of a wire bar, the polymer layer obtained was coated with coatings consisting of a moisture-curable acryl urethane silicon resin solution (UA-53, solid 49% available from SANYO CHEMICAL INDUSTRIES, LTD.) 12 parts, a saturated polyester resin VYLON, RV-220, available from TOYOBO CO., LTD.) 4 parts, a moisture-curable dimethylsiloxane-containing acryl silicon resin (F-6A, solid 54%, available from SANYO CHEMICAL INDUSTRIES, LTD.) 1.85 parts, a reaction accelerator (Cat. 65 MC, available from SANYO CHEMICAL INDUSTRIES, LTD.) 3.8 parts, toluene 15 parts, and 2-butanone 15 parts. The coated product was dried, and then treated at 100° C. for about 5 minutes to give a receiving sheet with a cured resin layer of 1.5 μm thick. No tack was observed on the surface of the receiving sheet even when it is held for long time as rolled.

An electroconductive carbon-containing aramid film (15 μm thick) was coated with a polyester type adhesive agent which was added with an isocyanate to form an anchor coat layer of about 0.1 μm thick, onto which an ink composition containing an indoaniline type cyan dye 6 parts, polycarbonate 4 parts, amido-modified silicone oil (KF-3935) 0.24 part, titanium dioxide 0.4 part, and toluene 100 parts was coated by means of a wire bar to give a dye-transfer sheet having a color layer of about 1.5 μm thick.

The receiving sheet and the transfer sheet were held between a current stylus head and a platen and pressed together at a pressure of about 3kg, and printing was conducted under the following conditions:

ratio of running speed of transfer sheet/receiving sheet: 1/5 printing energy: 6 J/cm$^2$

Consequently, a printing density of 1.60 was attained and the dyeable layer was not fused to the transfer sheet at all. The transfer sheet and receiving sheet both stably ran.

Subsequently, the printed image was allowed to stand in a thermo-hygrostat chamber at 60° C. and 60% RH for 300 hours, but the density of the printed image was not lowered at all.

EXAMPLE 2

An anchor coat layer prepared by the same manner and materials as described in the Example 1 was coated with a coating composition consisting of a colloidal aqueous dispersion type of polyester urethane resin (available from ASAHI DENKA KOGYO K.K., HUX-232, solid 30%) 10 parts and water 5 parts to form a polymer layer of about 4 μm thick. By means of a wire bar coater the polymer layer was then coated with a coating composition containing a moisture-curable acryl urethane silicon resin solution (available from SANYO CHEMICAL INDUSTRIES, LTD. UA-90, solid 50%) 12 parts, saturated polyester resin (VYLON, RV-220) 4 parts, a moisture-curable dimethylsiloxane-containing acryl silicon resin solution (F-6A) 1.85 parts, a moisture-curable fluorine-containing acryl silicon resin solution (available from SANYO CHEMICAL INDUSTRIES, LTD., F-2A, solid 48%) 0.22 part, talc (available from MATSUMURA SANGYO CO., LTD., #5000 PJ) 1 part, reaction accerelator (Cat. 65 MC) 3.8 parts, toluene 15 parts and 2-butanone 15 parts, and then the coated product was dried. The dried material was treated with heat at 100° C. for 5 minutes to give a receiving sheet with a cured resin layer of about 1.5 μm thick.

No tack was observed on the surface after the receiving sheet was held as rolled.

This receiving sheet and the same transfer sheet as in Example 1 were held between a current stylus head and a platen and pressed together at a pressure of about 3kg, and printing was conducted under the following conditions:

ratio of running speed of transfer sheet/receiving sheet: 1/5 printing speed: 4.2 ms/line printing energy: 4 J/cm$^2$

Consequently, a printing density of 1.55 was attained and the dyable layer was not fused to the transfer sheet at all. The transfer sheet and the receiving sheet both stably ran.

Then, the printed image was allowed to stand in a thermo-hygrostat chamber at 60° C. and 60% RH for 300 hours, but the density of the printed image was not lowered at all.

What is claimed is:

1. A dye-receiving sheet for a dye transfer type thermal printing which comprises a cured resin dyeable layer of a moisture-curable resin on a polymer layer which is formed on a substrate.

2. A dye-receiving sheet for a dye transfer type thermal printing of the claim 1, in which the moisture-curable resin is selected from the group consisting of a fluorine-containing moisture-curable resin or a silicone-containing moisture-curable resin.

3. A dye-receiving sheet for a dye transfer type thermal printing of the claim 1, in which the moisture-curable resin is selected from the group consisting of a moisture-curable acryl silicon resin or a moisture-curable urethane silicon resin.

4. A dye-receiving sheet for a dye transfer type thermal printing of the claim 1, in which the moisture-curable resin is a combination of at least one resin selected from the group consisting of a moisture-curable acryl silicon resin or a moisture-curable urethane silicon resin, and at least one resin selected from the group consisting of a fluorine-containing moisture-curable resin or a silicone-containing moisture-curable resin.

5. A dye-receiving sheet for a dye transfer type thermal printing of the claim 1, in which the cured resin dyeable layer contains a thermoplastic resin.

6. A dye-receiving sheet for a dye transfer type thermal printing of the claim 1, in which the polymer layer and/or the cured resin dyeable layer contain saturated polyester resin.

7. A dye-receiving sheet for a dye transfer type thermal printing of the claim 1, in which the polymer layer and/or the cured resin dyeable layer contains a vinyl resin.

8. A dye-receiving sheet for a dye transfer type thermal printing of the claim 1, in which the polymer layer and/or the cured resin dyeable layer contains a polyvinyl acetal resin.

* * * * *